United States Patent [19]

Gerlach et al.

[11] 4,361,609

[45] Nov. 30, 1982

[54] FIBER STRUCTURES OF SPLIT MULTICOMPONENT FIBERS AND PROCESS THEREFOR

[75] Inventors: Klaus Gerlach, Obernau; Nikolaus Mathes, Breuberg; Friedbert Wechs, Worth am Main, all of Fed. Rep. of Germany

[73] Assignee: Akzona Incorporated, Asheville, N.C.

[21] Appl. No.: 169,541

[22] Filed: Jul. 17, 1980

Related U.S. Application Data

[62] Division of Ser. No. 16,560, Mar. 1, 1979, Pat. No. 4,239,720.

[30] Foreign Application Priority Data

| | | | |
|---|---|---|---|
| Mar. 3, 1978 | [DE] | Fed. Rep. of Germany | 2809346 |
| Mar. 3, 1978 | [DE] | Fed. Rep. of Germany | 7806496[U] |
| Mar. 3, 1978 | [DE] | Fed. Rep. of Germany | 7806500[U] |
| Mar. 3, 1978 | [DE] | Fed. Rep. of Germany | 7806518[U] |
| Mar. 3, 1978 | [DE] | Fed. Rep. of Germany | 7806531[U] |
| Mar. 3, 1978 | [DE] | Fed. Rep. of Germany | 7806532[U] |
| Mar. 3, 1978 | [DE] | Fed. Rep. of Germany | 7806543[U] |
| Apr. 3, 1978 | [DE] | Fed. Rep. of Germany | 7806419[U] |
| Dec. 23, 1978 | [DE] | Fed. Rep. of Germany | 2856091 |
| Jan. 25, 1979 | [DE] | Fed. Rep. of Germany | 2902758 |

[51] Int. Cl.[3] ..... B32B 3/02; B32B 33/00; D04B 7/16

[52] U.S. Cl. ..... 428/90; 66/202; 428/97; 428/225; 428/296; 428/300

[58] Field of Search ..... 428/373, 374, 397, 399, 428/400, 253, 85, 90, 97, 224, 296, 292, 300, 288, 225; 66/169 R, 202

[56] References Cited

U.S. PATENT DOCUMENTS

| | | | |
|---|---|---|---|
| 3,117,362 | 1/1964 | Breen | 264/171 |
| 3,117,906 | 1/1964 | Tanner . | |
| 3,531,368 | 9/1970 | Okamoto et al. . | |
| 3,540,080 | 11/1970 | Goossens . | |
| 3,814,561 | 6/1974 | Matsui et al. . | |
| 3,853,977 | 12/1974 | Matsui et al. . | |
| 3,966,865 | 6/1976 | Nishida et al. | 264/147 |
| 4,073,988 | 2/1978 | Nishida et al. | 428/91 |
| 4,109,038 | 8/1978 | Hayashi et al. . | |

FOREIGN PATENT DOCUMENTS

| | | |
|---|---|---|
| 50-53503 | 5/1975 | Japan . |
| 51-92310 | 8/1976 | Japan . |

OTHER PUBLICATIONS

Okamoto, "Ultra-fine Fiber and its Application", Nov. 1977, Japan Textile News, pp. 94–97.

Okamoto, "Ultra-fine Fiber and its Application", Jan. 1978, Japan Textile News, pp. 77–81.

*Primary Examiner*—Lorraine T. Kendell

*Attorney, Agent, or Firm*—Francis W. Young; Jack H. Hall

[57] ABSTRACT

Fibrillatable multicomponent fibers of the matrix segment type and a process for production of fiber structures by splitting shrinkable, basically unset, multi-component fibers consisting of at least two incompatible components which in the fiber cross section are arranged in the form of a matrix and several segments, the latter accounting for about 20% to 80% of the total cross section. After having been processed into fiber structures such as staple fibers, yarns or fabrics, the multicomponent fibers are treated with a liquid or gaseous organic solvent, particularly chlorinated lower alkanes, to partially or completely split the segment filaments from the matrix component. Useful solvents are those which will reduce the zero-shrinkage temperature of the matrix or the segment polymer by at least 160° C. and in which the polymer components constituting the fiber show different shrinkage behavior. Splitting may be further enhanced by the application of mechanical agitation, e.g. by ultrasonic waves. Fabrics made from the multicomponent fibers may be woven, knitted, nonwoven, flocked and three-dimensional.

12 Claims, 10 Drawing Figures

FIBER STRUCTURES OF SPLIT MULTICOMPONENT FIBERS AND PROCESS THEREFOR

This is a division of application Ser. No. 016,560, filed Mar. 1, 1979, now U.S. Pat. No. 4,239,720.

The invention relates to fiber structures such as staple fibers, filaments, yarns, and sheet structures such as woven fabric, warp knits, webs and the like of split multicomponent fibers as well as to a process for the manufacture of such structures by splitting multicomponent fibers by treatment thereof with organic solvents.

BACKGROUND OF THE INVENTION

A number of processes are known for obtaining a fiber from two or more incompatible polymer components, whereby the polymer components may be distributed over the fiber cross-section in many different ways. Also, various methods have been tried to separate the components of multicomponent fibers after spinning.

Okamoto in an article entitled "Ultra-Fine Fiber and Its Application", *Japan Textile News,* November 1977, pp. 94–97 and December 1977, pp. 77–81, summarized known techniques for making fine-denier fibers and in particular, the ultra-conjugate (converging) fiber spinning method (Integral Fiber's Method). The fiber produced is described as having "islands-in-a-sea".

U.S. Pat. No. 3,531,368 illustrates the details of several types of nozzles referred to in the aforesaid Okamoto article and describes a process for the manufacture of a matrix microfilament yarn wherein a great many very fine microfilaments (segments) of component A are surrounded by a matrix component B and separated from each other by the latter. This type of structure is obtained by first pre-molding bicomponent structures material is simultaneously forced into each segment formed by the above mentioned radial thin layers and the wall of the line, to embed the above mentioned thin streams between the stream of the latter spinning material. Finally, the combined stream is extruded through the discharge opening without disrupting the flow line of the thin layer. Although FIGS. 1–6 of this patent illustrate cross-sections with segments from three to six, the production of filaments with three and five or more segments (with the exception of six segments) is difficult. Moreover, the spinning heads described in this patent are also difficult to make and conversion of the spinning heads from one cross-section to another, for example from four segments to six segments, matrix and segment filaments is not described; rather, this patent merely teaches one to dissolve or decompose one of them with water or organic solvents.

In U.S. Pat. No. 3,540,080, a great many yarn cross-sections having more than two segments composed of different polymer components are disclosed. All segments are composed of different polymer components, not separated by a matrix component. Moreover, most the yarn cross-sections are encased in the matrix component. Although it is the objective of many recent developments in the field of multicomponent yarns, these yarns cannot be separated by mechanical and/or chemical aftertreatment into a yarn bundle composed of extremely fine filaments and/or fibers.

In British Pat. No. 1,104,694, fine denier filaments are obtained from matrix-fibril filaments by preliminary treatment of the matrix-fibril filaments, e.g. by treatment with heat, solvents or swelling agents followed by flexural stressing. However, this process results in filaments with only a partial and very uneven fibrillation. Textile sheet structures obtained from such filaments are of limited use and lack the desired softness and the required silk-like luster. Moreover, they leave much to be desired in terms of covering power.

U.S. Pat. No. 3,966,865 teaches the manufacture of textile fiber structures from multicomponent filaments of polyamide and other polymers by using for fibrillation an aqueous emulsion of 1.5 to 50 wt. % benzyl alcohol and/or phenylethyl alcohol obtained by means of a surfactant. A prereequisite is that the treatment solution transmits less than 20% of the light having a wavelength of 495 nm. One drawback of this process is that the composition of the treatment agent as well as the treatment conditions must be accurately controlled. It is extremely difficult to obtain a specific degree of fibrillation with this process; frequently, the fibrillation of the filament is only incomplete. Also, the textile sheet structure must be subjected to a relatively long treatment to induce any appropriate fibrillation. This treatment causes the fibers to readily stick to one another. There is also the risk of chemical modification of polyamides during treatment so that the end product no longer has the required characteristics.

Similar processes are also described in U.S. Pat. No. 4,073,988 which mentions a series of other organic solvents used as solutions or emulsions in water. Essentially the same drawbacks are experienced with these procedures as mentioned above in connection with U.S. Pat. No. 3,966,865. Furthermore, considerable difficulties are experienced in processing aqueous solutions of emulsions containing organic solvents; the recovery of pure organic solvents for further use is not only complex, but there are various problems in water decontamination with are significant especially in terms of antipollution.

U.S. Pat. No. 3,117,362 describes the treatment of multicomponent fibers with acetone. Although the filaments are treated fro five minutes in the solvent, there was no significant separation and only partial splitting is achieved when drawing the filament over a sharp edge. Complete splitting was only achieved after repeating such mechanical aftertreatment three times.

Although a number of methods for splitting multicomponent fibers and obtain corresponding fiber structures are known, there is still a need for improved processes leading to fiber structures having better properties. Accordingly, an object of the invention is to provide a process permitting the manufacture of fiber structures by splitting of multicomponent fibers simply, economically and reproducibly to a specific, desired degree of splitting.

Another object is to provide filaments that can be completely separated giving a uniform bundle structure distinguished by a very fine denier, a soft, silk-like hand, a high covering power having many varied applications in the textile and industrial sector.

An object of the invention is to provide patterned, dyeable knit goods characterized by variations in optical transparency or relief effects having a very pleasing appearance and a pleasant soft textile hand and excellent drape.

Another object of the invention is to provide a web characterized by an especially high density and uniformity, high covering power and good tenacity and particularly by a high degree of mutual matting of the fibers which may further be bonded at the points of intersection of segments and/or matrix fibers.

DESCRIPTION OF THE INVENTION

In the context of the invention, "fiber structure" includes linear structures, such as staple fibers of determinate lengths as well as virtually continuous linear structures, such as filaments, or yarns from continuous fibers and also sheet structures such as woven, knitted, laid fabrics, webs or fleeces and flocked substrates. Sheet structures provided on one or both sides with a pile or the like and three dimensional structures, such as wadding, loose or compressed molded or non-molded fiber structures are also included.

As used herein, the term shrinkable means that the polymer of the matrix or segment in the yarn cross section will shrink, that is, will become shorter as a result of the solvent treatment of the invention.

The shrinkage capacity of the fiber depends upon its history and shrinkage conditions such as temperature, treatment times, solvent used, etc. The shrinkability of the fibers is especially influenced by conditions prevailing during the spinning and/or drawing of the fibers.

Adequate shrinkage according to the invention can be imparted to the fiber generally by drawing the fibers in the conventional manner used in the production of polyester filaments to three times or more the original length thereof. Adequate shrinkage can also be achieved by drawing off the spinning filament at elevated speed and subjecting it to a low draw ratio. Also, air drawing as conventionally used in the production of spinning webs may lead to the required shrinkage.

The important point is that either the matrix component or segment components exhibit a significant shrinkage in the solvent. Expediently, the shrinkage should be at least 10%, with a shrinkage of at least 15% being preferred.

Whether the production conditions lend a sufficient shrinkage need not necessarily be tested with the multicomponent fiber as such, but rather a monocomponent filament can be tested that has been obtained under otherwise identical conditions but using exclusively matrix or segment polymer, in other words with the same production conditions as for multicomponent fiber, i.e. the same spinning draw off and draw ratio, fibers consisting exclusively of polyester are obtained, the shrinkage of which is determined in the solvent.

To determine the shrinkage, the fibers are essentially treated in keeping with the proposed splitting conditions, e.g. a 50 cm long fiber skein with distance markers at both ends is immersed for five minutes at 35° C. in methylene chloride. The shrinkage is the difference between the distance markers before and after treatment with the solvent.

It is furthermore important that matrix and segment components exhibit a differential shrinkage in the solvent. For example, the matrix material chosen may shrink, while segments do not or vice versa. Both matrix and segment material may be shrunk, but it is essential that a differential shrinkage exist. Differential shrinkage can be obtained either as a difference in the induction time or the total shrinkage or the shrinkage rate between the matrix material and the segment material.

The induction time is the time at which the shrinkage in the treatment medium becomes perceptible. The induction time for shrinkage of one of the matrix or segment components should be at a minimum and preferably on the order of only seconds. The differential shrinkage behavior may also be satisfied if either the matrix or the segments have a higher shrinkage rate than the other.

Methods of determinating the induction time are given in two articles by N. L. Lindner in Colloid and Polymer Sci. 255, pp. 213 et seq and 433 et seq (1977), which are incorporated herein by reference.

The term "essentially nonset", as used herein, means that the multicomponent fibers before treatment with the solvent have not specifically been subjected to thermal treatment in such a way that the initial shrinkability resulting from the spinning and/or drawing conditions would have been entirely or partly eliminated. Furthermore, setting e.g. with chemical agents, except as herein described, should be avoided before the actual splitting treatment.

The term "fiber" in the framework of the invention means both fibers of finite length such as short cut of conventional staple fiber, and substantially continuous structures, such as filaments.

As used herein, "multicomponent fibers with components arranged as matrix and plural segments" means fibers having individual segments and matrix arranged continuously and uninterruptedly along the fiber axis in such a way that the fiber cross section is essentially the same over the entire fiber length. The matrix refers to the component in which the other components (segments) are encased or embedded. Examples of fiber cross sections especially suitable within the framework of the invention are shown in FIGS. 1–7, whereby a represents the matrix and b the segments.

The term "mutually incompatible" polymers means that the polymers cannot be mixed with each other and do not enter into any chemical reaction with each other and that in particular e.g. when mixed together in the melt or as component spun together side by side to a multicomponent fiber, exhibit a distinct phase boundary under the given conditions. Polyamide and polyester especially fall within said category of incompatible polymers whereby polyester based on terephthalic acid is preferred within the framework of the invention. In the melt, these two polymers do not perceptibly enter into reaction with each other, at least not within specific time periods, so that practically no blend polymers are formed, which would solidly bond the two phases together. It is, of course, understood that conditions for exchange reactions which might take place in the melt after some time between polyester and polyamides, for instance, as described in Doklady Akademii Nauk SSSR 1962, Vol. 147, No. 6, Page 13, 165 to 8, are not permitted.

As used herein, "complete splitting" means that one or several peripheral segments are separated completely from the composite of the original multicomponent fiber. "Partial splitting" means that the segment fiber is still integral with the matrix compound of the original multicomponent fiber. This term is intended to include slits which may have formed between peripheral segment fibers and matrix fibers. It has been noticed that incipient splitting is also possible in the form of external, longitudinal grooves along the phase boundaries.

Multicomponent fibers suitable for use in the invention can be obtained with suitable spinnerets or spinning units using, for example, polyamides and polyesters, by conventional melt processes, provided the fibers are drawn to impart to them adequate shrinkability. Multicomponent fibers of this type can be obtained in an especially advantageous manner according to the process and apparatus described in copending U.S. patent application Ser. No. 6,491 filed Jan. 25, 1979, which is incorporated herein by reference.

In an especially advantageous version of the instant process, multicomponent fibers obtained according to said U.S. application Ser. No. 6,491, with a polyester matrix and peripheral segments of polyamide or vice versa are split by treatment with an organic solvent.

The still shrinkable, multicomponent fibers obtained e.g. according to the teaching of said U.S. application Ser. No. 6,491 exhibit a sufficiently high adhesion force between matrix and segments that the multicomponent fibers can be subjected to conventional processing without substantial splitting, but have sufficient shrinkability to split into individual components in the presence of the solvent.

FIGS. 1–6 of the above mentioned application are identical with FIGS. 1–6 of the above present application and reference may be had to said application for a complete description. For purposes of the present disclosure, the following brief description of FIGS. 1–6 will suffice:

Figure 7A:
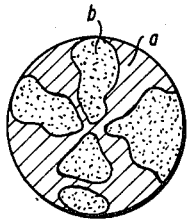
FIG. 7A represents a multicomponent filament having segments with an irregular shape.
Figure 7B:
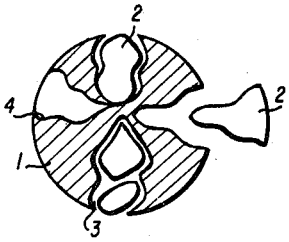

FIG. 7B schematically shows a matrix-segment fiber having a cross section similar to FIG. 7A in which matrix fibers and segment fibers are partially split.

Figure 8:
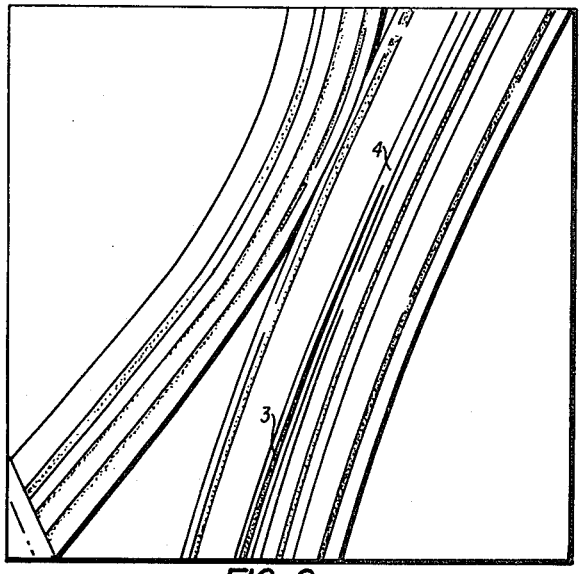

FIG. 8 is a schematic longitudinal view of the partially split fiber shown in cross section in FIG. 7B.

Figure 9:
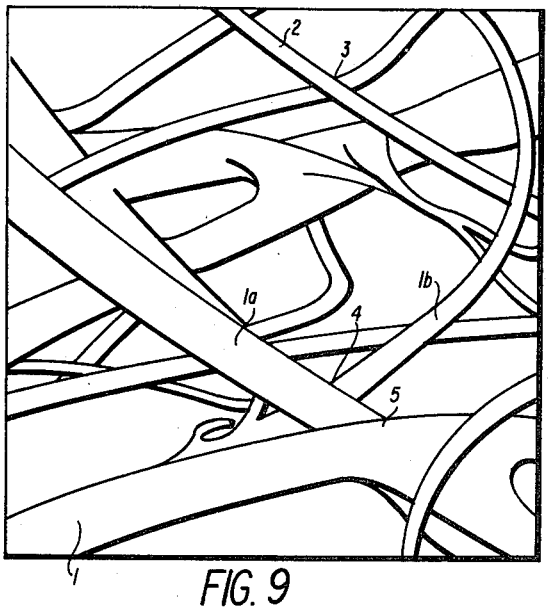

FIG. 9 is a schematic sketch showing the details of a bonded web made from split multicomponent fibers of the invention.

Organic solvents in terms of the invention refer to chemical substances which bring about physical dissolution of other substances. It is not necessary or even desirable that the solvent dissolve one or all polymers of which the multicomponent fibers are composed. The solvent should allow maximum shrinkage of the matrix fibers and by contrast minimum or no shrinkage of the segments or vice versa.

The zero shrinkage temperatures can be determined according to a process as e.g. described in Lenzinger Berichte May 1976, supplement 40, page 22 to 29. To this end, dynamic shrinkage curves of filaments must be determined in the solvent being considered for treatment of the multicomponent fibers. Extrapolation of the linear portion of the dynamic shrinkage curve indicates the zero shrinkage temperature as the intersection point with the abscissa.

It has been found that chlorinated lower alkane ($C_1$–$C_4$) solvents and particularly methylene chloride, 1,1,2,2,tetrachloroethane, 1,1,2-trichloroethane and chloroform adequately lower the zero shrinkage temperature of the matrix or segment polymer and induce an unexpectedly favorable splitting of the multicomponent fibers.

The process of the invention causes a substantial shrinkage of the matrix or segment fibers of generally at least 10%, preferably at least 15–25%, leading to the splitting of matrix and segment fibers.

Treatment time is generally very brief and frequently, a few seconds to one or a few minutes are sufficient to obtain the desired splitting. With the solvent according to the invention, e.g. methylene chloride, there is no need for auxiliaries so that practically pure solvent can be employed without diluents and other additives.

Treatment with methylene chloride can be carried out at room temperature as well as at higher temperatures. The treatment can also be performed with methylene chloride gases.

Within the framework of the invention, a great many fiber structures can be obtained by splitting of the multicomponent fiber. For instance, one may obtain linear fiber structures, i.e. fibers of finite length exhibiting a great variation in length. It is also possible to split so-called short cut fibers. Even staple fibers of 10, 20, 50, 100 mm length and longer can be split. It is also possible to split fibers of practically continuous length generally referred to as filaments. Splitting of the multicomponent fibers can be accomplished not only in fiber structures, such as staple fibers or continuous filaments, but also in fiber structures in the form of textile or industrial structures obtained by processing of the multicomponent fibers into knits, woven fabrics, plaited structures, laid structures and webs, especially webs with random arrangement of the fibers and needle-punched webs, wadding, flocked substrates as well as structures provided on one or both sides with a pile before solvent treatment as described herein.

The multicomponent fiber of the invention can have a cross section as shown in FIGS. 7 and 8, in which the parts of the segments surrounded by the matrix have an irregular shape, sometimes jagged or serated.

The invention contemplates completely and/or partially splitting the peripherally arranged segments from the matrix either before or after processing the multicomponent fibers into sheet-like structures.

As shown in FIGS. 7 and 8, the multicomponent fiber can be partially split portions of the multicomponent fibers still having a mechanical cohesion between matrix and segments. The partially split portions of the multicomponent fiber are not yet separated from one another and still display mechanical cohesion. Slits 3 may be formed between matrix and peripheral segments, but in other portions of the fiber no splitting has taken place or only incipient splitting as indicated by longitudinal grooves 4, which extend on the exterior along the fiber, in a longitudinal direction, corresponding to the phase boundaries.

The process of the invention is especially suitable for the production of loop goods, such as warp knit and circular knit materials as well as woven materials. A sheet structure is first obtained by knitting, warp knitting, or weaving of unsplit multicomponent fibers or filaments. The sheet structure is then treated in a solvent so that the fibers in the textile sheet structure shrink leading to compacting thus creating among other things interesting optical effects and a high covering power of the sheet structure. Treatment of these fiber structures with the solvent causes differential shrinkage of the matrix or segment components. The segment or matrix filaments (having the least shrinkage) are bent and become visible as protruding arches projecting above and below the surface plane of the sheet structure.

In the treatment of multicomponent fibers of finite length, during splitting a certain bending of the fibers occurs whereby the bending of the segment fibers is on the whole more pronounced than that of the matrix fibers. Especially in sheet structures, such as webs, with random arrangement of the fibers said bending of the segment fibers and simultaneous shrinkage produce a surface shrinkage whereby the material is substantially compacted and acquires enormous covering power. Simultaneously there is an extremely high degree of matting producing a very strong cohesion between fibers.

Fiber structures according to the invention may be composed wholly or in part of completely or partially split multicomponent fibers. Conventional monocomponent fibers for example polyester and/or polyamide fibers may also be incorporated in the fiber structures. For instance, woven or knitted fabrics can be constructed from fibers, yarns or filaments containing only multicomponent fibers or multicomponent fibers combined with monocomponent fibers. Woven fabrics may contain yarns and filaments consisting partly of multicomponent fibers and partly of other conventional fibers, e.g. filling yarn of multicomponent fibers and warp yarns from polyester.

The above mentioned fiber structures, i.e. linear structures and sheet structures, can be obtained by methods known to the practitioner. Special patterns or effects achieved by conventional techniques such as texturing, malimo, weaving and knitting, laying, varying weaving patterns and yarn counts can be augmented by the effect of the solvent treatment of the invention on the structure.

In a special version of the process of the invention, woven or knitted goods of still unsplit multicomponent fibers are provided with set (stabilized) areas. This setting of specific areas can be accomplished for example by embossing the knit wear, warp knit or woven material in a regular or irregular pattern with a hot embossing calender. This treatment causes areas to be set so that the fibers are unable to shrink. Consequently, in subsequent treatment with the solvent, only those areas which have not been set are able to shrink, creating among other things interesting optical and tactile effects.

By hot embossing with a calender exhibiting raised areas arranged in a pattern, it is simultaneously possible to compact the material in the set areas.

Setting of specific areas can of course also be accomplished by other processes for example chemical setting, treatment with steam and the like.

To create corresponding patterns and effects, it is furthermore possible to treat sheet structures from still unsplit multicomponent fibers only in specific areas with solvent, e.g. by conventional printing processes.

Furthermore, by selective application of suitable pastes e.g. based on polyacrylates, in a pattern, access of the methylene chloride inducing the splitting can be inhibited so that splitting will only occur in areas not treated with paste.

In some cases it is expedient if during treatment with the solvent the multicomponent fibers are subjected to an additional mechanical treatment. This can be achieved e.g. by mechanical agitation of the fibers.

The mechanical treatment of the fiber structures such as staple fibers, yarns or sheet structures can be accomplished in that the material is agitated in the treatment bath, e.g. by stirring, by regular or irregular raising and lowering, by squeezing and relaxing or by a fulling treatment.

During treatment with the organic solvent, the fiber structure may be subjected to ultrasound to produce the desired mechanical treatment. This can be achieved by carrying out the treatment with the organic solvents in vessels of the type used for ultrasonic cleaning. Equipment of this type is available commercially and is mentioned for instance in Bulletin CP-100 BE-1-72, Branson-Europa N.V. These units generally consist of a tank to treat the material with the solvent and are equipped with an ultrasonic generator in the housing. Using ultrasonic vibration in conjunction with solvent treatment, it is possible to achieve splitting even in difficult cases. For instance, when treating materials on skeins with methylene chloride, a much more pronounced splitting is obtained when the material on skeins is simultaneously subjected to ultrasonic waves. Knit goods of multicomponent fibers treated with methylene chloride also show a substantially more pronounced splitting when simultaneously subjected to ultrasonic waves.

In the production of fiber structures, when multicomponent fibers of a cross section as illustrated in FIG. 7 are used, simultaneous exposure to ultrasound during treatment with the organic solvent will produce a substantially more pronounced splitting than without appropriate mechanical additional treatment or ultrasonic treatment.

Ultrasonic treatment is especially advantageous in the production of webs, since in addition to improved splitting it simultaneously leads to matting which increases the tenacity.

It was very surprising that the process of the invention made possible a simple, rapid and controlled splitting of the fibers alone as well as in a textile sheet structure. Splitting requires only a brief treatment, e.g. by immersion in a suitable bath or by brief treatment with a gaseous solvent, without any additional auxiliaries, such as surfactants or water. It is not necessary to prepare emulsions or dispersions so that recovery of the solvent used for treatment does not present any problems or cause pollution. Since the treatment is very brief, neither fibers nor sheet structures are damaged. The textile sheet structures are especially soft, have a high covering power and a special uniformity and interesting optical effect.

Flocked substrates can be obtained as follows:

Multiple component fibers of suitable cutting length are applied by conventional flocking procedure onto a substrate e.g. a fabric coated with an adhesive before setting and while they are still shrinkable.

After securing the fiber on the substrate, treatment with the solvent follows, whereby matrix and peripheral segment fibers are entirely or partly split. The advantage of this process for the production of a fine fiber flock is that longer staple lengths can be used for flocking than is possible in conventional processes, since the fiber before splitting has a heavier denier and the fine denier is only developed after flocking.

The matrix of the fiber used for making flocked substrates may comprise one or more core segments of polyalkylene terephthalate completely encased in a matrix of polyamide. The polymer of the segments is preferably polyethylene terephthalate or polybutylene terephthalate. The individual denier of the peripheral segments may vary within wide limits and ranges expediently between 0.1 and 3 dtex, the matrix denier ranges expediently between 0.5 and 20 dtex. However, heavier and finer deniers are also possible.

Webs according to the invention can be obtained by otherwise known processes, e.g. by suitable laying of the multicomponent fibers. Splitting of the fibers can be accomplished before the sheet structure is laid or after it has been formed.

A web composed of multicomponent fibers of the matrix-segment type described herein having for example, a polyamide matrix and peripheral segments of polyalkylene terephthalates can be made by conventional techniques. After treatment with a solvent, the multicomponent fibers will be either wholly or partly split into matrix fibers and segment fibers by virtue of differential shrinkage between the matrix and segment fibers of at least about 10%. The matrix fibers are preferably in random arrangement and the split off segment fibers will have a greater curvature than the matrix fibers due to the greater shrinkage of the matrix fibers.

The web exhibits a high degree of matting resulting from split off curled segment fibers. The web may be needle punched before the solvent treatment, in which case any unevenness or indentations caused by needle punching will no longer be apparent. The filament denier of segment and matrix fiber of the web of the innovation may vary within wide limits; favorable values range between 0.1 to 4 dtex for the segment fibers and between 0.5 and 20 dtex for the matrix fiber. Higher values are, however, also possible. The staple length of the multicomponent fibers forming the web may also vary within wide ranges.

If the fibers are to be bonded at their points of intersection, this is accomplished with heat, e.g. hot water, saturated steam, hot air, contact heat by means of hot rollers and the like, with or without pressure. Bonding of the fibers is accomplished by partial melting one of the polymer components. It is, of course, understood that the bonding component has a lower melting point than the nonbonding component.

A bonded web may be made from randomly laid multicomponent fibers having polyamide matrix and segments of polyalkylene terephthalates, which are split up either wholly or partly into matrix fibers and segment fibers. Bonding of the fibers can take place at the points where segment fibers intersect with lower melting matrix fibers and where matrix fibers intersect each other. Where segment fibers intersect with other segment fibers, bonding does not occur at the temperatures used. In FIG. 9, a magnified section of a bonded web as above described is shown graphically. A segment fiber 2 intersects another segment fiber at point 3 without bonding. A segment fiber **1*b* and a matrix fiber a intersecting at point 4 are bonded. At intersection point 5, two intersecting matrix fibers, 1 and 1*a*** are also bonded.

With the process of the invention, the still unsplit multicomponent fibers can be subjected to conventional procedures such as winding and unwinding, twisting, weaving, knitting, etc., without any appreciable splitting. Separation into segment and matrix fibers of the finished fiber structure can then be carried out at any convenient time.

The process of the invention is very economical since there is no material loss due to dissolving out the polymers. The fiber structures of the invention exhibit a very high water retention. An especially advantageous feature of the invention is that products can be obtained containing both fine and heavy deniers. For instance, fiber structures with segment fibers of 0.1 to 3 dtex and matrix fibers of 0.5 to 20 dtex can be obtained. Special effects in terms of hand can be achieved by appropriate distribution of denier sizes.

The invention is illustrated by the following examples:

EXAMPLE 1

Figure 3:
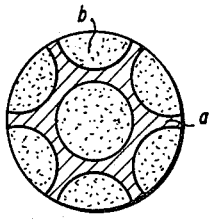
FIG. 3 represents a cross section of a multicomponent filament according to the invention having six peripherally aligned segments and a core segment.
Figure 4:
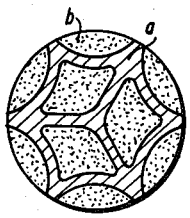
FIG. 4 represents a cross section of a multicomponent having six peripheral segments and three core segments.
Figure 5:
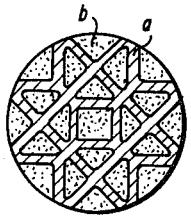
FIG. 5 represents a cross section of a filament having eight peripheral segments and thirteen core segments fully encased in the matrix component.
Figure 6:
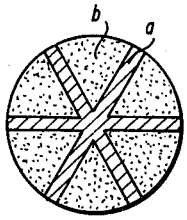
FIG. 6 represents a cross section of a multicomponent filament having six separate segments extending into the core zone of the cross section.

Using a spinneret like the one described in copending U.S. patent application referred to above, a multicomponent filament of polyethylene terephthalate (segments) (rel. viscosity 1.63) and nylon 6 (matrix) (rel. viscosity 2.20) in a weight ratio of 80 to 20 was spun. The filament, with a cross section as shown in FIG. 3, had a denier of dtex 50 f 30. The spinning speed was 1200 mpm and a draw ratio of 1:3.26 was used. A 50 cm long fiber skein of the resulting filament was immersed for 1 minute at 35° C. in methylene chloride. The solvent was removed by blotting with filter paper and the skein dried at 80° C. in a circulating air drier. The fibers were almost totally split into matrix and segment fibers, as clearly visible under a microscope. Shrinkage of the filaments in methylene chloride was 22%.

EXAMPLE 2

Using the same spinneret as in Example 1, a filament was spun under otherwise identical conditions, except that instead of using nylon 6 in the segment component, a mixed polyamide based on 60% ε-caprolactam and 40% hexamethylene adipamide was used. After drawing, the filament was cut to lengths of 5 mm. Subsequently, the fibers were split by treatment with methylene chloride, then suspended in water to which a dispersing agent was added and processed on conventional sheet forming equipment to form a wet web. The web was bonded while drying at 95° C. due to softening of the polyamide.

EXAMPLE 3

A knit material weighing about 100 g/m$^2$ was made from the continuous filaments of Example 1 before being split. Subsequently, the knit material was passed through the gap of an embossing calender heated to 220° C. whereby the embossed areas of the knit material corresponding to the raised areas of the calender were heated to about 180° C. and thereby set, whereas the other areas remained unset. Treatment with methylene chloride at 35° C. for 1 minute caused splitting of the fiber in the unset areas.

EXAMPLE 4

Figure 1:
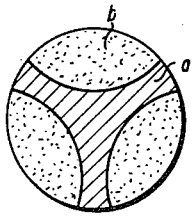
FIG. 1 represents the cross section of a matrix-segment multicomponent filament of the invention having three separate segments.
Figure 2:
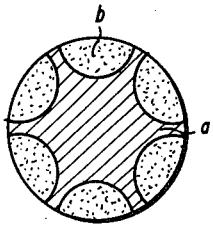
FIG. 2 represents a cross section of a multicomponent filament of the invention having six segments separated from each other by a matrix.

Using a spinneret as described in said copending U.S. patent application, a multicomponent filament of polyethylene terephthalate (matrix) (rel. viscosity 1.63) and nylon 6 (segments) (rel. viscosity 2.20) in a weight ratio of 75 to 25 was spun. The filament, with a cross section as shown in FIG. 2 had a denier of 50 dtex f25. The spun filament is taken up at 1200 mpm, with a draw ratio of 1:3.26. The resulting filament in the form of a 50 cm long skein was immersed for 10 minutes at 35° C. in methylene chloride, then the solvent was substantially removed by blotting with filter paper and the material was dried at 80° C. in a circulating air drier. The fibers were fully fibrillated. Longitudinal shrinkage of the filament methylene chloride was about 20%.

EXAMPLE 5

A flat knit material weighing about 100 g/m$^2$ was made from the still unsplit continuous filaments of Example 4. Subsequently, this greige knit was immersed for about 5 minutes in methylene chloride at 35° C. and dried in a circulating air drier. The resulting specimen was fully fibrillated. The segments are predominantly located peripherally at the top and back of the knitted material, resulting in a fabric having superior covering power, a soft, bulky hand and a silk-like luster.

EXAMPLE 6

Another sample of a multicomponent filament obtained according to Example 4 was knit into a two-bar knit material. In the first bar said matrix-segment filament, having a denier of 50 dtex f 30 was laid in a 3–4 satin stitch, while polyester filaments of a denier of 50 dtex f 14 were used in the second bar. Emerizing and breaking is followed by treatment in methylene chloride at 35° C. for 5 minutes and drying. The initially unsplit pile threads were fibrillated. While the fine segments remain at the surface, the heavier matrix shrinks inward. The material has a dense, soft pile characterized by a good "marking" effect.

EXAMPLE 7

Using a spinneret of the type described in the above mentioned U.S. patent application, a matrix-segment filament with 9 peripheral segments of 40 dtex f 5 is spun from polyethylene terephthalate (segments) (rel. viscosity 1.63) and nylon 6 (segments) (rel. viscosity 2.20) in a weight ratio of 80:20. The spinning speed was 1200 mpm. The draw ratio was 1:3.8. The resulting filament was made into flat knit material and for comparison one part each of the specimen was immersed in a bath containing methylene chloride at 35° C. for 1 minute with and without the application of ultrasonic vibrations, respectively, followed by drying in a circulating air drier. The latter specimen showed an incomplete separation of individual components due to pronounced wedging of the filaments while the filaments of the specimen subjected to the ultrasound treatment were totally split up.

EXAMPLE 8

Using unsplit continuous filament made in accordance with Example 7, staple fiber of a length of 45 mm was cut and processed into a needle punched web with 80 stitches per cm$^2$. The fibers were separated in a tank equipped with an ultrasonic device with methylene chloride at 35° C. The specimens treated with ultrasound during fibrillation had the same good quality level as specimens without ultrasound treatment, but additionally, the components were completely separated and the web had a high degree of matting and consequently, a higher tenacity.

We claim:

1. A fiber structure composed of partly split multicomponent fibers of the matrix-segment type, characterized by partial splitting up into matrix fibers and segment fibers, whereby the only partly split multicomponent fibers still show a mechanical coherence of matrix and segment components, with, in part, slits between the matrix and segment fibers and, in part, merely longitudinal grooves at the edge of the multicomponent fiber, which correspond to the phase boundaries.

2. The fiber structure of claim 1 comprising woven or knitted sheet structure having segment fibers protruding above and below the surface plane and wherein said matrix and segment fibers have finite length and differential curvature, whereby said segment fibers exhibit on the whole a more pronounced curvature than said matrix fibers.

3. The fiber structure of claim 1 wherein said matrix and segment fibers are randomly arranged and have finite length and differential curvature, whereby said segment fibers exhibit on the whole a more pronounced curvature than said matrix fibers.

4. The fiber structure of claim 2 or 3 having predetermined areas in which said multicomponent fibers are not split.

5. The fiber structure of claim 4 wherein said unsplit areas are compacted and uniformly distributed on the surface of said sheet structure.

6. The fiber structure of claim 1 comprising a nonwoven web having multicomponent fibers comprising segment fibers bonded with segment fibers at their points of intersection and bonded segment fibers with matrix fibers at their points of intersection.

7. The fiber structure of claim 1 comprising a nonwoven web having multicomponent fibers comprising matrix fibers bonded with other matrix fibers at their points of intersection and segment fibers bonded with matrix fibers at their points of intersection.

8. The fiber structure of claim 6 or 7 wherein the multicomponent fibers form a needle punched web.

9. The fiber structure of claim 1 comprising one or more core segments of polyalkylene terephthalates.

10. The fiber structure of claim 6 wherein said segment fibers comprise a mixed polyamide.

11. The fiber structure of claim 10 wherein said mixed polyamide is a copolymer based on ε-caprolactam and hexamethylene diamine/adipic acid.

12. The fiber structure of claim 9 wherein said multicomponent fibers comprise staple fibers flocked into a substance.

* * * * *